US007172186B2

(12) United States Patent
Saito et al.

(10) Patent No.: US 7,172,186 B2
(45) Date of Patent: Feb. 6, 2007

(54) SHEET STACKING APPARATUS AND IMAGE FORMING APPARATUS EQUIPPED WITH THE SAME

(75) Inventors: Takashi Saito, Yamanashi (JP); Yuji Hanawa, Nirasaki (JP); Hiroki Imazu, Minami-Alps (JP)

(73) Assignee: Nisca Corporation, Yamanashi-ken (JP)

( * ) Notice: Subject to any disclaimer, the term of this patent is extended or adjusted under 35 U.S.C. 154(b) by 42 days.

(21) Appl. No.: 10/834,902

(22) Filed: Apr. 30, 2004

(65) Prior Publication Data

US 2004/0251608 A1 Dec. 16, 2004

(30) Foreign Application Priority Data

May 20, 2003 (JP) ..... 2003-141391
May 28, 2003 (JP) ..... 2003-150032
May 28, 2003 (JP) ..... 2003-150034

(51) Int. Cl.
*B65H 39/00* (2006.01)

(52) U.S. Cl. ..... 270/58.08; 271/221; 271/222; 399/410; 270/58.11; 270/58.12; 270/58.27

(58) Field of Classification Search ..... 270/58.11, 270/58.27, 58.08, 58.12; 399/410; 271/222, 271/221

See application file for complete search history.

(56) References Cited

U.S. PATENT DOCUMENTS 5,449,157 A * 9/1995 Kawano et al. ..... 270/58.11
5,480,130 A * 1/1996 Suzuki et al. ..... 270/58.11
5,735,108 A * 4/1998 Tuji ..... 53/540
5,765,824 A * 6/1998 Kawano et al. ..... 270/58.11
6,047,960 A * 4/2000 Kawano et al. ..... 271/184
6,382,616 B1 * 5/2002 Waragai et al. ..... 270/58.12
6,412,774 B1 7/2002 Saito et al.
6,527,269 B2 * 3/2003 Yamada et al. ..... 271/221
6,561,503 B1 * 5/2003 Ogata et al. ..... 270/58.12
6,671,492 B2 12/2003 Mimura et al.
6,889,971 B2 * 5/2005 Tamura et al. ..... 270/58.11
2003/0062669 A1 * 4/2003 Yamakawa et al. ..... 271/176
2003/0155705 A1 * 8/2003 Sekiyama et al. ..... 271/241

FOREIGN PATENT DOCUMENTS

JP 2002-179322 6/2002
JP 2002179322 A * 6/2002

* cited by examiner

*Primary Examiner*—Gene Crawford
*Assistant Examiner*—Leslie A. Nicholson, III
(74) *Attorney, Agent, or Firm*—Manabu Kanesaka

(57) ABSTRACT

A sheet stacking apparatus includes a sheet transport path for transporting a sheet; a discharge device disposed adjacent to the sheet transport path for sequentially transporting the sheet; a support tray disposed adjacent to the discharge device for temporarily supporting at least a part of the sheet transported by the discharge device; a stacker disposed at a downstream side of the support tray for stacking and storing the sheet transported from the support tray; a sheet pushing member disposed on the support tray for abutting against an edge of the sheet stacked on the support tray; and a drive device capable of rotating in forward and reverse directions. The drive device reciprocally moves the sheet pushing member between a retracted position at an upstream side of a stacking position where the sheet is stacked on the support tray and a transport position at a downstream side of the stacking position.

15 Claims, 9 Drawing Sheets

SHEET STACKING APPARATUS AND IMAGE FORMING APPARATUS EQUIPPED WITH THE SAME

BACKGROUND OF THE INVENTION AND RELATED ART STATEMENT

The present invention relates to a sheet stacking apparatus installed in an image forming apparatus such as a printer or copier, and particularly relates to a sheet stacking apparatus equipped with a sheet support tray for temporarily holding a sheet when a finishing process such as stapling, punching and marking is performed on the sheet with an image formed thereon, and an image forming apparatus equipped with the sheet stacking apparatus.

Generally, a sheet stacking apparatus is installed at a final processing portion of a device such as a printer, copier or facsimile machine for sequentially stacking and storing sheets processed by an image forming apparatus. The sheet stacking apparatus includes one type in which a pair of transport rollers nips a sheet to transport to a stacker, and another type in which a push-out member pushes a trailing edge of a sheet to transport to a stacker after the sheet is temporarily stacked on a support tray.

The invention relates to the latter type, i.e. a sheet pushing mechanism moves a sheet from a tray for temporarily supporting the sheet to a stacker for sequentially stacking the sheet. The invention also relates to a mechanism for aligning the sheet on the support tray for temporarily supporting the sheet and for securely discharging the sheet from the tray.

Japanese Patent Publication (Kokai) No. 2002-060118 has disclosed a conventional sheet pushing mechanism in which a predetermined number of sheets are stacked on a tray for temporarily supporting the sheets, and a push-out member protruding above the tray pushes a bundle of the sheets toward a stacker. The tray is provided with a long groove at a center portion thereof extending from a side that the sheet is transported to a side that the sheet is discharged. The push-out member is arranged to protrude above the tray from a backside thereof. The push-out member has a base portion attached to an endless belt disposed at the backside of the tray. When a pulley of the endless belt rotates, the push-out member moves from a trailing end to a leading end on the tray. Accordingly, the push-out member revolves around the tray together with the endless belt disposed at the backside of the tray, so that the push-out member stands upward above the tray in a half rotation of the endless belt, and revolves downwardly at the backside of the tray in the other half rotation of the endless belt.

Japanese Patent Publication (Kokai) No. 2002-179322 has disclosed a similar structure, in which a protruding push-out member revolves around an endless belt. In such a structure, it is necessary to provide a large space for the push-out member, and it is difficult to arrange a component such as a sensor at the backside of the tray, thereby increasing a size of the apparatus.

In the conventional finishing apparatus, it is necessary to temporarily store sheets from an image forming apparatus on a tray for finishing, and transport the finished sheets to a discharge stacker. The tray for temporarily stacking the sheets is provided with aligning means for aligning the sheets at a predetermined position for finishing, and transporting means for transporting the finished sheets (single sheet or a bundle of sheets) to a discharge tray.

In general, the aligning means includes a pair of aligning plates arranged on left and right sides for pushing sides of the sheets to align in a width direction. When the center of the sheet is used as a reference, the aligning plates move to the center. When a side edge of the sheet is used as reference, one of the aligning plates is fixed, and the other of the aligning plates moves. The transporting means includes a pair of rollers or an endless belt rotatably disposed on the stacker, or a sheet pushing member disposed on the tray to be reciprocally movable for pushing the trailing edge of the sheets. Particularly, when the sheets are stapled into a bundle, the sheet pushing member is preferably used.

The sheets are stacked on the tray, and the aligning plates abut against the sheets for alignment as described above. After the sheets are finished (stapled), the sheet pushing member (protruding portion) moves the sheets to fall into a discharge stacker for storage. As a method of aligning the sheet, it is known that a tray curved in a direction perpendicular to the aligning direction aligns the sheets using stiffness of the sheets, thereby preventing the sheets from being curled and disorganized. It is also known that protruding guide means such as a rib is disposed in the tray, so that when the sheets are discharged, the sheets are forcibly bent in a direction perpendicular to the transport direction for securely transporting the sheets.

When the sheets are temporarily stacked on the tray, the sheets are aligned in a direction perpendicular to the transport direction. In the case that the tray is curved to correctly align the curled or thin sheets, when the sheets are transported, the sheets tend to bend, thereby causing a transport problem or the trailing edge of the sheet to remain on the tray. In the case that the protruding guide means such as a rib is disposed in the tray for securely transporting the sheets, the sheets tend to bend and it is difficult to correctly align the sheets. Therefore, it is necessary to provide a flat tray for, temporary stacking the sheets even in a case that a curled sheet or a thin sheet is processed in the image forming apparatus. Also, it is necessary to discharge the sheets from the tray in a flat state, thereby causing a problem in aligning and discharging the sheets.

In view of the problems described above, a first object of the present invention is to provide a compact and simple sheet stacking apparatus with low cost, while solving the problems in which the protruding member revolves around the endless belt and the apparatus needs a large space.

A second object of the present invention is to provide a sheet stacking apparatus in which a pushing member is not caught by a sheet when the pushing member moves at a backside of a tray after the pushing member pushes a trailing edge of the sheet to the stacker and passes the sheet stacked on a stacker, even when an excessive amount of sheets is stacked on the stacker or the sheets are curled.

A third object of the present invention is to provide a sheet stacking apparatus in which a pushing member pushes the sheets on a stacker to align the sheets after the pushing member transports the sheets to the stacker.

A fourth object of the present invention is to provide a sheet stacking apparatus in which it is possible to discharge the sheets from a stacker and securely align the sheets without negative effect on the alignment.

Further objects and advantages of the invention will be apparent from the following description of the invention.

SUMMARY OF THE INVENTION

In order to achieve the objects described above, according to the present invention, a sheet pushing member abutting against a trailing edge of a sheet is disposed on a support tray for temporarily supporting the sheet, and reciprocally moves backward and forward.

Specifically, according to the present invention, a sheet stacking apparatus includes discharge means disposed in a sheet transport path for sequentially discharging a sheet; a support tray for temporarily supporting at least a portion of the sheet transported from the discharge means; a stacker disposed at a downstream side of the support tray for stacking and storing the sheet transported from the support tray; a sheet pushing member disposed on the support tray for abutting against an edge of the sheet stacked on the support tray; and drive means capable of rotating in forward and reverse directions for reciprocally moving the sheet pushing member between a retracted position at an upstream side of a position on the support tray where the sheet is stacked and a discharge position at a downstream side thereof. With this configuration, the sheet pushing member does not need to revolve around the support tray, thereby making the apparatus compact.

In the invention, the sheet pushing member includes a pushing member protruding upwardly from the support tray and abutting against a trailing edge of the sheet. The drive means includes a belt member placed between the retracted position and the discharge position and a motor capable of rotating in forward and reverse directions for reciprocally moving the belt member.

In the structure described above, the pushing member is configured to push the sheet on the stacker at a position, or a transport position, where the sheet is transported out. Accordingly, the sheet pushing member pushes the sheet after the sheet is stored on the stacking tray, thereby maintaining a stacked shape of the sheet.

In the structure described above, the drive means is controlled so that the sheet pushing member moves from the transport position to the retracted position at a speed faster than that of the sheet pushing member moving from the retracted position to the transport position, thereby reducing a time for discharging the sheet.

According to the present invention, a sheet stacking apparatus includes a support tray for finishing a sheet; a stacker disposed adjacent to the support tray for stacking and storing the sheet transported from the support tray; aligning means for aligning an edge of the sheet on the support tray; sheet discharge means having a sheet pushing member for transporting the sheet to the stacker; a path for transporting the sheet from the support tray to the stacker; and a sheet bending member disposed in the path for bending the sheet in a direction perpendicular to a transport direction and arranged movably between a striking position where the sheet bending member protrudes into the path and a retracted position, so that the sheet bending member is located at the retracted position when the sheet is aligned, and is located at the striking position when the sheet is transported.

With this structure, when the sheet is aligned, the sheet is aligned with the support tray having a flat shape or curved shape suitable for the alignment. When the sheet is transported, the sheet bending member bends the sheet in a direction perpendicular to the transport direction for securely transporting the sheet to the stacker using stiffness of the sheet.

As described above, according to the invention, the sheet stacking apparatus includes the support tray for stacking the sheet fed sequentially; the aligning means for pushing an edge of the sheet on the support tray to align the sheet at a predetermined position; the stacker arranged adjacent to the support tray for storing the sheet fed from the support tray; the sheet discharge means for feeding the sheet on the support tray to the stacker; the sheet bending member capable of moving between the protruding position for bending the sheet on the support tray and the retracted position away from the sheet; and the moving means for moving the sheet bending member to the retracted position when the sheet is aligned and to the protruding position when the sheet is discharged to the discharge stacker.

In the structure described above, finishing means may be provided for finishing the sheet on the support tray such as stapling, opening holes or marking. Accordingly, it is possible to align and finish the sheet on the support tray.

In the structure described above, the sheet discharge means includes a sheet pushing member disposed on the support tray and capable of moving in a sheet discharge direction, and drive means for driving the sheet pushing member in the sheet transport direction, so that the sheet pushing means abuts against the trailing edge of the sheet to move the sheet. Accordingly, it is possible to securely transport a bundle of the sheets without wrinkle.

In the structure described above, the sheet bending member may be disposed at one or a plurality of locations on the support tray in a width direction of the sheet perpendicular to the sheet transport direction, so that the sheet bends in a hill or wave shape in the direction perpendicular to the sheet transport direction and does not bend in the transport direction, thereby eliminating a transport problem.

In the structure described above, the sheet bending member may be formed of a hook-shaped member having a sheet pushing surface for abutting against the trailing edge of the sheet on the support tray and a sheet pushing surface for abutting against the uppermost sheet. Accordingly, the hook-shaped member holds the trailing edge and the top of the sheet on the support tray while the sheet is pushed, so the sheet does not bend upwardly.

According to the invention, a sheet stacking apparatus includes a support tray for stacking a sheet fed sequentially; aligning means for pushing an edge of the sheet on the support tray to align the sheet at a predetermined position; a stacker arranged adjacent to the support tray for storing the sheet fed from the support tray; sheet discharge means for feeding the sheet on the support tray to the stacker and including a sheet pushing member; a sheet bending member capable of moving between a protruding position that the sheet bending member protrudes upwardly for bending the sheet on the support tray in a direction perpendicular to the sheet transport direction and a pushing position that the sheet bending member abuts against the upper most sheet on the stacker; and moving means for moving the sheet bending member between the protruding position and the pushing position.

In the structure described above, the sheet bending member bends and securely transports the sheet to the stacker at the protruding position when the sheet is transported from the support tray to the stacker. After the sheet is stacked on the stacker, the sheet bending member pushes the uppermost sheet not to curl when the next sheet is transported, thereby securely transporting the sheet and the next sheet with a simple mechanism.

In the structure described above, the sheet bending member is formed in a shape for abutting against the sheet on the support tray at one or more locations in a width direction of the sheet perpendicular to the sheet transport direction, so that the sheet bends in a direction perpendicular to the sheet transport direction and securely reaches the stacker.

In the structure described above, the sheet discharge means and sheet bending means have shapes such that the sheet discharge means and sheet bending means abut against the sheet at two locations in the sheet width direction perpendicular to the sheet transport direction, thereby transporting the sheet without skew.

In the structure described above, the sheet discharge means and the sheet bending means are connected to same drive means. The drive means is connected to a sheet regulating member via a delay transmission mechanism. Accordingly, it is possible to make drive devices such as a drive motor and an electromotive mechanism compact.

According to the invention, an image forming apparatus includes image forming means for forming an image on a sheet, and is provided with the sheet stacking apparatus described above, thereby obtaining the same advantages described above.

DETAILED DESCRIPTION OF PREFERRED EMBODIMENTS

Figure 1:
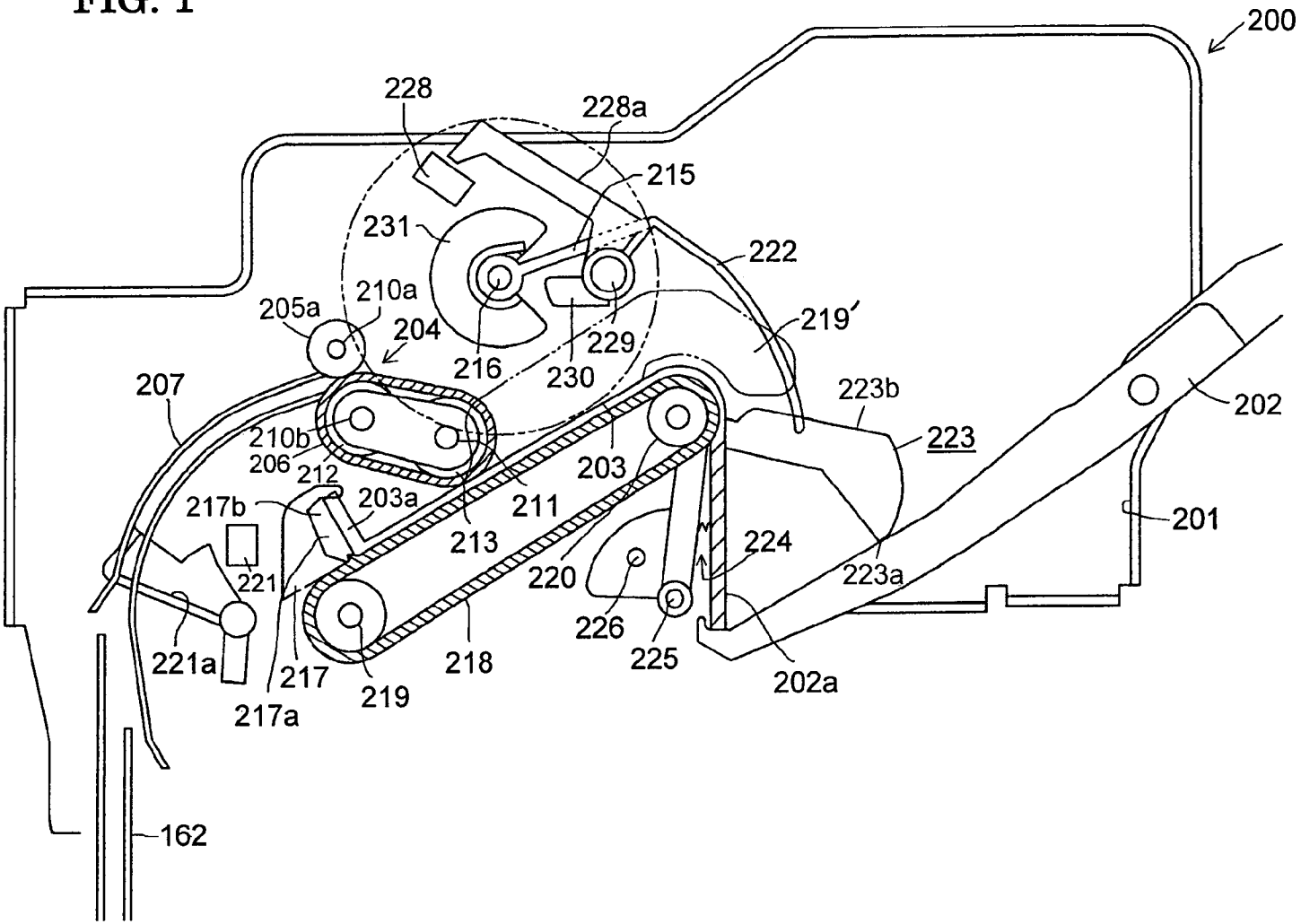
FIG. 1 is a view showing an essential part of a sheet stacking apparatus according to an embodiment of the present invention.
Figure 2:
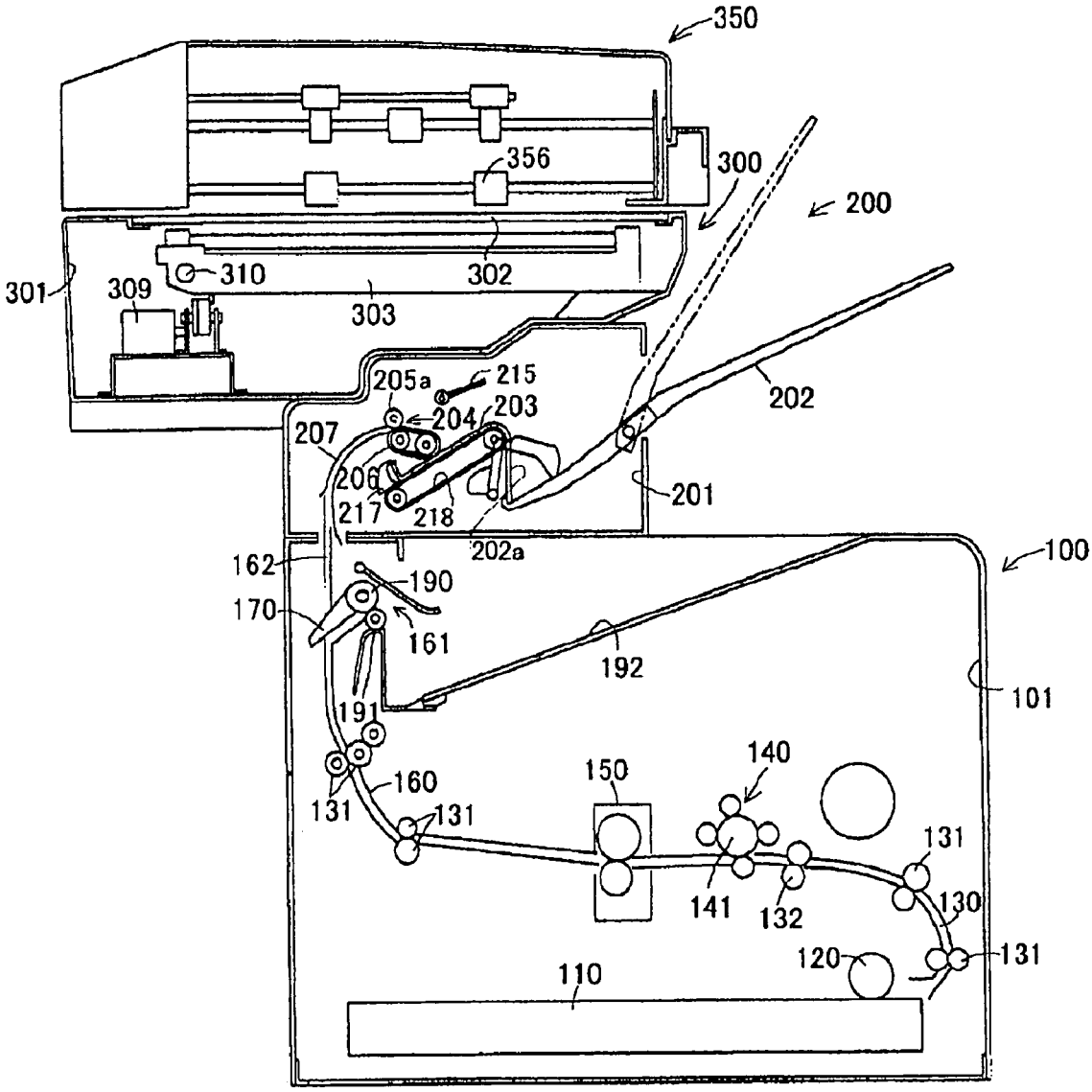
FIG. 2 is a view showing an overall structure of an image forming apparatus according to an embodiment of the present invention.

Hereunder, embodiments of the present invention will be explained in detail with reference to the accompanying drawings. FIG. 1 is a view showing an essential part of a sheet stacking apparatus according to an embodiment of the present invention. FIG. 2 is a view showing an overall structure of an image forming apparatus according to an embodiment of the present invention.

As shown in FIG. 2, the image forming apparatus is composed of an image forming unit 100, sheet finishing unit 200, image reading unit 300, and original feeding unit 350. Each of the units has a unitized structure, and is incorporated in a separate casing. By combining each unit, it is possible to provide an apparatus for various purposes. The sheet finishing unit 200 is installed above the image forming unit 100, and the image reading unit 300 with the original feeding unit 350 is installed above the sheet finishing unit 200.

To reduce a space of the apparatus, each unit is mounted above the other to compose the image forming apparatus. The image forming unit 100 is used as an output printer connected to, for example, a computer, or has the following structure to be used as a copier connected to the image reading unit 300. In a casing 101, there are disposed a paper cassette 110, printing means 140, fixing means 150, a transport path 130 that sequentially feeds sheets in order, and a discharge path 160. The paper cassette 110 is detachably incorporated in the casing 101 for storing a predetermined number of the sheets. The paper feed roller 120 is disposed to rotate in the counterclockwise direction at a position that touches the uppermost sheet in the paper cassette 110 when it is installed in the apparatus. A corner pawl (not shown) is disposed in the paper cassette. Therefore, when the paper feed roller 120 rotates, only the uppermost sheet is separated and drawn into the transport path 130.

A transport roller 131 and register rollers 132 are disposed in the transport path 130. The sheet led into the transport path 130 is fed with the transport roller 131 to the paired register rollers 132 where they idle. The printing means 140 is disposed at a downstream side of the register rollers 132. A variety of printing means are known. It is possible to employ, for example, an ink jet printing system, thermal transfer printing system, or an offset printing system. The system shown in the drawings is an electrostatic printing system. In the drawings, reference numeral 141 represents an electrostatic drum (photosensitive body). Around it are arranged a laser beam emitting device that forms a latent image on the electrostatic drum, a developer that affixes toner ink, and an antistatic device that transfers the ink to the paper.

A latent image is formed on the electrostatic drum by the laser emitter, according to the image signal from a computer. Toner ink is affixed over the latent image by the developer. While a paper is idling at a position of the register rollers 132, the toner ink is transferred to the sheet sequentially. Reference numeral 150 in the drawings represents fixing means composed of heating rollers that press together. These feed the sheet to the discharge path 160 while fixing the toner ink on the sheet.

The discharge rollers 190 and 191 and stacker 192 are disposed at the discharge outlet 161 at a leading end of the discharge path 160. The discharge rollers 190 and 191 stack the sheets in the stacker 192. Therefore, after the printing means 140 prints a predetermined image on the sheet from the paper cassette 110 and the sheet is fixed at the fixing means 150, it is stacked and stored in the stacker 192 from the discharge outlet 161.

The linking path 162 for leading the sheets to the finishing unit (described below) branches from the path connected to the discharge outlet 161, and is disposed on the discharge path 160. A switching gate 170 selects whether the sheet is fed to the discharge outlet 161 or the linking path 162. Specifically, drive means (not shown) composed of a solenoid is disposed in the switching gate 170 to feed the sheets to the linking path 162, while the switching gate 170 rotates by a predetermined angle in the counterclockwise direction from the state shown in FIG. 2 to close the path toward the discharge outlet 161.

The sheet finishing unit 200 is composed of a casing retaining a support tray 203 that temporarily holds the sheets sequentially fed from the image forming unit 100; the finishing means 25Q such as a stapler that binds a predetermined number of the sheets supported on the support tray into a bundle; a punch that punches holes at a predetermined position on the sheets, or a stamp that marks the sheets; and a stacker 202 that stores the sheets after finished.

The discharge rollers 205*a* and 205*b* are arranged at the discharge outlet 204 on the transport path 207 connected to the linking path 162 on the image forming unit 100 to nip the sheets and to discharge the sheets to the right side of FIG. 2.

Below that is arranged the support tray 203 that temporarily holds the sheets. Continuing below the support tray 203 is the stacker 202. Each is arranged to form at a different level.

Therefore, the sheets with images formed with the image forming unit 100 are led from the linking path 162 to the transport path 207 in the sheet finishing unit 200 and stored in the support tray after passing through the discharge outlet 204. The sheets processed at the sheet finishing unit 200 (described below) are then stored in the stacker 202.

The image reading unit 300 is mounted along with the original feeding unit 350 above the sheet finishing unit 200 on the image forming apparatus shown in the drawings. The image reading unit 300 includes a casing 301; a platen 302 for setting originals; a carriage 303 capable of reciprocating movement along the platen 302; a light source 304 mounted on the carriage; a mirror 305; a lens 306; and photoelectric conversion elements 307.

Figure 3:
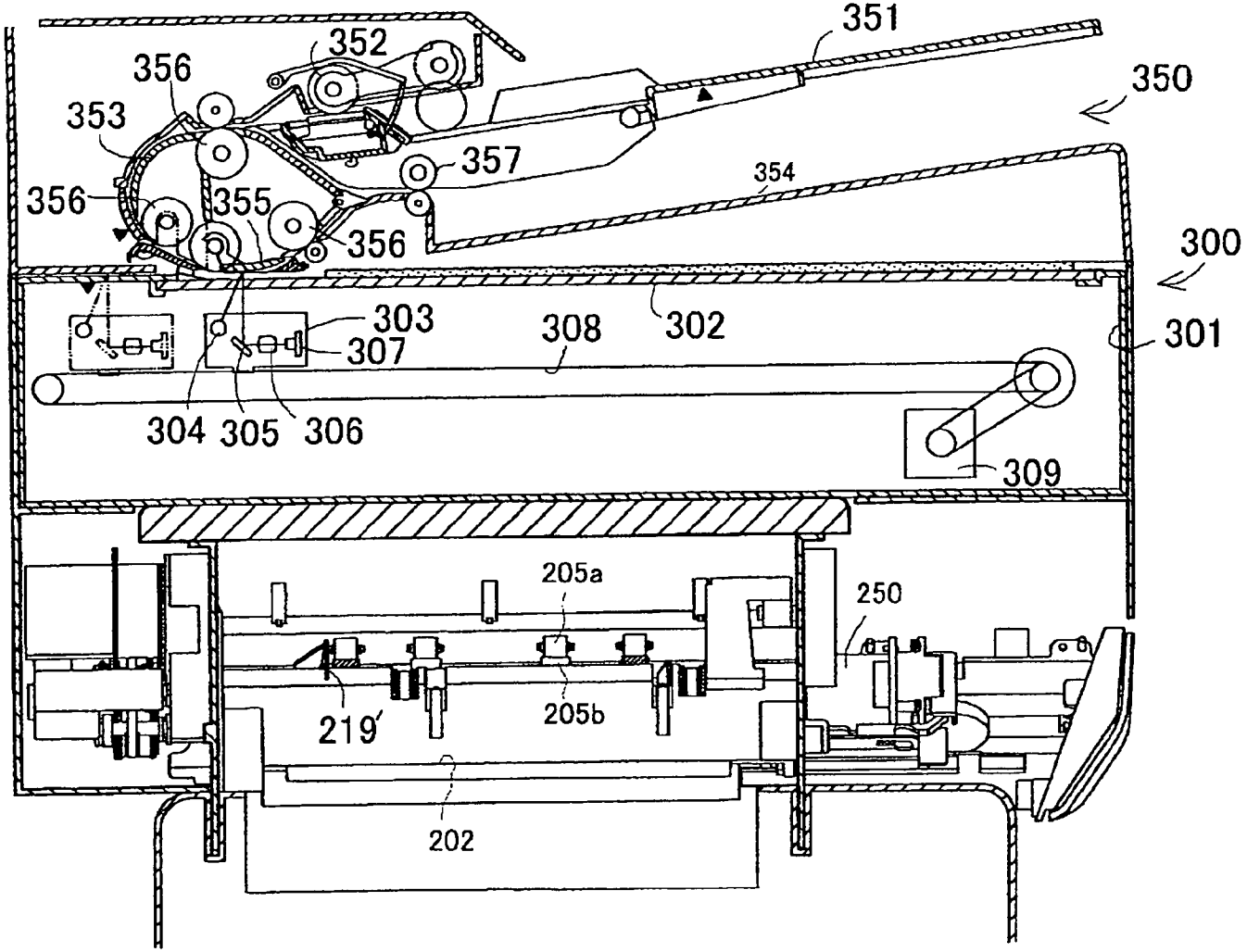
FIG. 3 is a view showing an essential part of the image forming apparatus according to the embodiment of the present invention.

The carriage 303 is supported on a guide rail 310 fastened to the casing 301. It is connected to the endless belt 308 placed between a pair of pulleys. The carriage 303 is configured to move to the left and right directions in FIG. 3 by the drive motor 309 connected to the pulleys. As shown in FIG. 3, the drive motor 309 controls a position of the carriage 303 with a timing belt mated with the endless belt 308. The hidden line position shown in FIG. 3 for the carriage 303 is a home position.

Therefore, the carriage 303 moves to the right in FIG. 3 from the home position when it receives the read starting signal to begin reading the images on the original set on the platen 302. During the movement, the light from the light source is reflected on the original and is directed through the lens 306 by the mirror 305 to the photoelectric conversion elements 307 where an image is formed. This is then converted into electrical signals and output. The photoelectric conversion elements 307 shown in the drawing output the accumulated electric charge of the light reflected from the original by a CCD (charge coupled device) to an external device at a predetermined clock speed. The electrical signal is sent to the image forming unit 100 or an external computer as image data.

An original feeding unit 350 is mounted to the image reading unit 300 as an attachment. The original feeding unit 350 is composed of an original feeding tray 351; paper feed rollers 352 that separate the sheets into a single sheet and feed the sheet from the tray; a paper feed path 353 that leads the original from the paper feed rollers 352 to the platen 302 on the image reading unit 300; and a discharge tray 354 for storing the originals from the paper feed path 353.

Reference numeral 355 in the drawing represents a backup plate disposed in a position that corresponds to the platen 302 on the paper feed path 353. The backup plate supports the backside of the original at the reading position to prevent blurring of the images thereupon the original. In the drawings, reference numeral 356 represents the pair of transport rollers that are equipped in the paper feed path 353. Reference numeral 357 represents the discharge rollers; each of them is connected to a drive motor. Therefore, the originals are set on the original feeding tray 351, and then by sending a start signal, they are sent sequentially to the reading position on the paper feed path 353. At this point, the carriage in the image reading unit 300 is stationary at the position delineated by the solid lines in FIG. 3 to optically read the original sequentially as it passes over at a predetermined constant speed. The read original is then stored in the discharge tray 354 via the discharge roller 357.

In the sheet finishing unit 200, the sheet with images formed thereupon at the image forming unit 100 is led from the linking path 162 on the image forming unit 100 to the transport path 207 on the sheet finishing unit 200. The support tray 203 that temporarily supports the sheets is arranged below the discharge outlet 204 on the transport path 207. Further below the support tray 203 is arranged the stacker 202. With this configuration, the sheets from the discharge outlet 204 are transported to the support tray 203, and then to the stacker 202.

The support tray 203 and stacker 202 are configured of trays with proper shapes to stack the sheets, and are obliquely arranged so that the leading edges of the sheets in the transport direction become higher. At the side of the trailing edges of the sheets are equipped the stopper walls 203*a* and 202*a* that align the trailing edges of the sheets.

Therefore, the sheets sent from the discharge outlet 204 are discharged along the support tray 203 first, and stacked sequentially while the stopper wall 203*a* aligns the trailing edges. Next, the sheets are discharged to the stacker 202 after being finished. They are aligned by the stopper wall 202*a*, and then stacked.

Note that the shape of the support tray 203 can be formed to be longer than the length of the sheets in the transport direction (left to right direction in the FIG. 1), but in the drawings it is depicted to be smaller (or shorter). This further contributes to the overall compactness of the apparatus. Therefore, the trailing edges of the sheets, or at least the longest sheets can be supported on the support tray 203, and the leading edges can be supported on the stacker 202 by forming a bridge.

A pair of the discharge rollers 205*a* and 205*b* disposed in the discharge outlet 204 nips and transports the sheets, and a discharge belt 206 leads the sheets from the discharge rollers to the support tray 203. The discharge rollers 205*a* and 205*b* can be made of rubber or a compound plastic. They are mounted at a position where they press against each other on the rotating shafts 210*a* and 210*b* mounted to an apparatus frame. The discharge belt 206 is an endless belt, or a caterpillar belt, made of rubber and formed with protruding ridges, and is placed between the pair of pulleys 212 and 213. One pulley 212 is fastened to the rotating shaft 210*b*, and the other pulley 213 is supported on the bracket 214 rotatably mounted to the rotating shaft 210*b*. Therefore, the pulley 213 swings in the up and down directions in FIG. 2 around the pulley 212 with the endless belt 206 touching the sheets stacked on the support tray on the pulley 213 side. It rises and lowers according to an amount of the sheets stacked on the support tray.

A drive motor is connected to the rotating shaft 210*b* to rotate the discharge roller 205*b* and the endless belt 206 in the clockwise direction in FIG. 1. The discharge roller 205*a* that presses against the discharge roller 205*b* is configured to be a follower roller. Also, the paddle 215 is equipped at the discharge outlet 204 in the position shown in FIG. 4. The paddle 215 is formed of soft rubber into a plate shape and is fastened to the rotating shat 216 mounted to the apparatus frame. The rotating shaft 216 is rotatably controlled to move the sheets stacked on the support tray toward the stopper wall 203*a*. This is described in further detail below.

The aligning member 219' that aligns the width direction of the sheets stacked on the support tray 203 is disposed movably in the front to back direction in FIG. 1 (direction perpendicular to the sheet transport direction). The aligning member 219' includes a plate-shaped member that moves reciprocally in a direction perpendicular to the sheet transport direction to abut against the edges of the sheets on the support tray 203. A rack arranged on the backside of the support tray 203 is connected to the plate-shaped member.

The rack mates with a pinion connected to the forward and reverse motor for the reciprocal movement.

As shown in FIG. 3, the finishing means 250 that finishes the stacked sheets is arranged on the support tray 203. The drawing depicts a stapling mechanism that binds the sheet bundles stacked on the support tray 203. Linked staples formed in a straight band shape (not shown) are retained in the staple mechanism 250. The staple mechanism is configured to execute the stapling of the sheet bundles with a former that bends the staples into a U-shape and driving the bent staples firmly into the sheet bundle with the drive of the drive motor. Additionally, disposed on the backside, or below the sheet bundle, is an anvil that bends the staple tips inward toward each other to complete the stapling process. Other finishing means such as a punch mechanism to punch holes in the sheets, or a marking mechanism that marks the sheets can be used as the finishing unit 250 instead of the stapling mechanism described above. It is also perfectly acceptable to arrange the finishing means above the support tray 203 together with the stapling mechanism. A variety of mechanisms are already well known and in use. Still further equipped on the support tray 203 is a sheet pushing member 217 that discharges the finished sheets to the stacker 202.

The sheet pushing members 217 shown in the drawings is a protruding member that protrudes through two elongated holes formed in the support tray 203 and is capable of moving on the support tray 203 in the left and right directions in the FIG. 1. The sheet pushing member 217 is formed in a shape having a sheet touching surface 217*a* that touches the trailing edge of the sheet bundle and pushes it, and a sheet pushing surface 217*b* that is connected to the touching surface 217*a* and touches the uppermost sheet. The sheet pushing member 217 is fastened to the motion belt 218 disposed at the backside of the support tray 203. The motion belt 218 is formed of an endless belt placed between the pulleys 219 and 220 mounted at the backside of the support tray 203. The drive for the motion belt is described in further detail below.

In the drawings, reference numeral 221*a* represents a sensor lever disposed in the second transport path 207 for detecting the leading and trailing edges of the sheet. Reference numeral 221 represents a sensor that electrically detects the action of the sensor lever. Also, the sheet holder 223 that presses the uppermost sheet is equipped on the stacker 202. The sheet holder 223 constantly presses the uppermost sheet because it is easy for the sheets on the stacker to come into disarray by curling or getting partially built up by the stapling process or can cause mis-operation of the full sensor.

As shown in FIGS. 6(*a*) to 6(*b*), reference numeral 224 represents an urging spring that applies pressure to the sheet holder 223 to urge the sheet holder 223 in the clockwise direction in FIGS. 6(*a*) to 6(*b*). It is necessary to retract the sheet holder 223 from the top of the sheets when the sheets are fed from the support tray 203. For that reason, the sheet holder 223 is rotatably supported on one side of the shaft 225 of the lever member to swing between the pushing position in FIG. 6(*a*), and the retracted position in FIG. 6(*d*). The cam follower pin 226 is unitized to the sheet holder 223. The cam 227 abuts against the cam follower pin 226. The rotation of the cam 227 (in the counter clockwise direction in FIGS. 6(*a*) to 6(*d*)) resists the spring 224 to move the sheet holder 223 from the pushing position to the retracted position. The drive for the cam 227 is described in further detail below.

Figure 7:
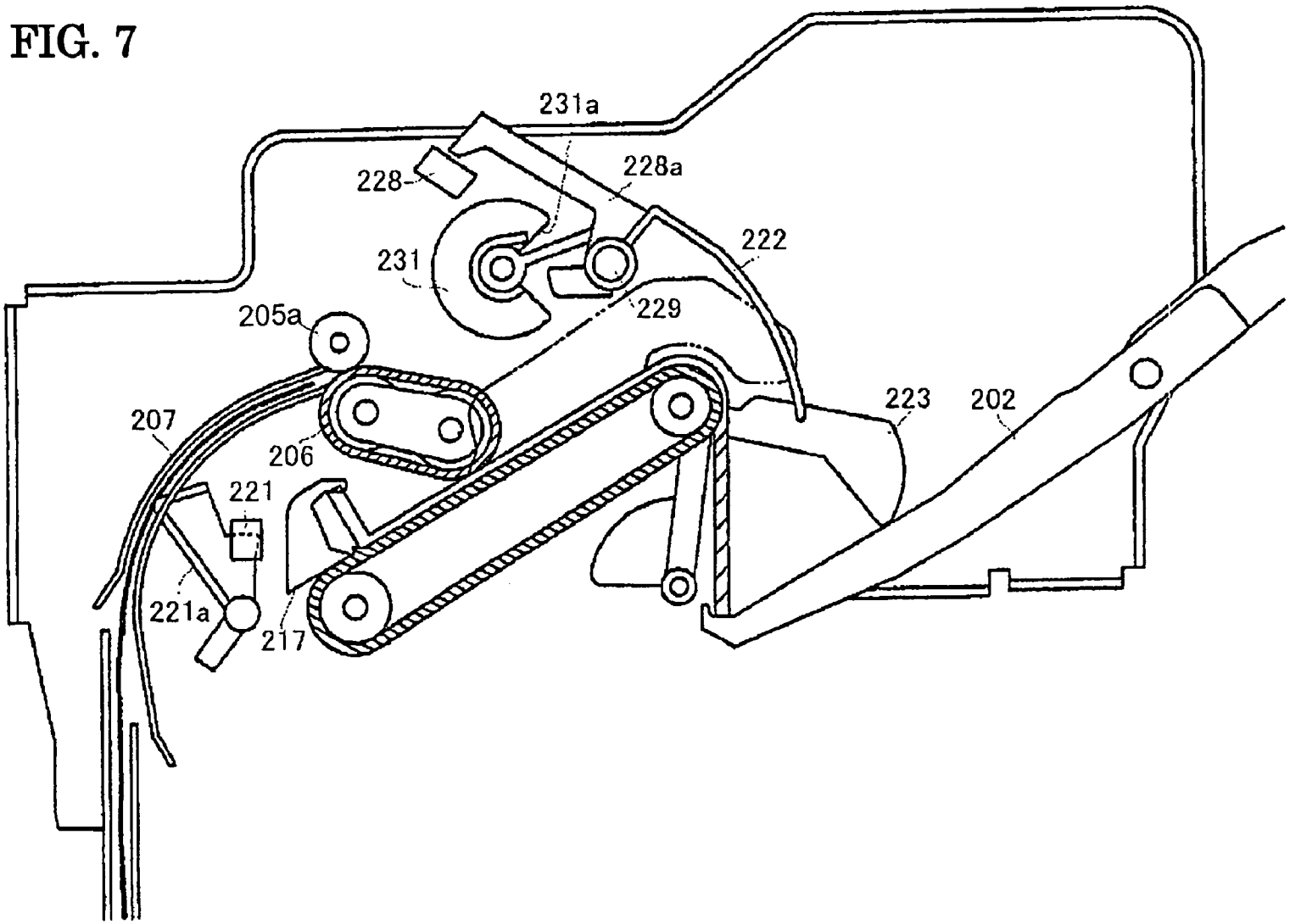
FIGS. 7–9 are views showing operations of a detection lever in the sheet stacking apparatus shown in FIG. 1.

The full detection lever 222 that detects the uppermost position of the stacked sheets is equipped on the stacker 202. As shown in the drawings, the arm-shaped lever 222 lowers to the top of the stacker 202 from above the support tray 203. Reference numeral 228, shown in FIG. 7, is a sensor for detecting the movement of the lever 222. The full detection lever 222 lowers to the top of the stacker 202 from above the support tray 203 to detect an amount of the sheets at a position closer to the center of the sheets on the stacker, so that it is possible to accurately detect the correct amount of the sheets stacked on the stacker, even when the edges of the sheets are enlarged because of the staple finishing process. It is necessary to retract the full detection lever 222 from the transport path when the sheets on the support tray 203 are transported from the sheet discharge outlet 204. Shown in the drawings, the base of the lever 222 is rotatably supported on the shaft 229 and the cam follower 230 is unitized to the base.

Figure 5:
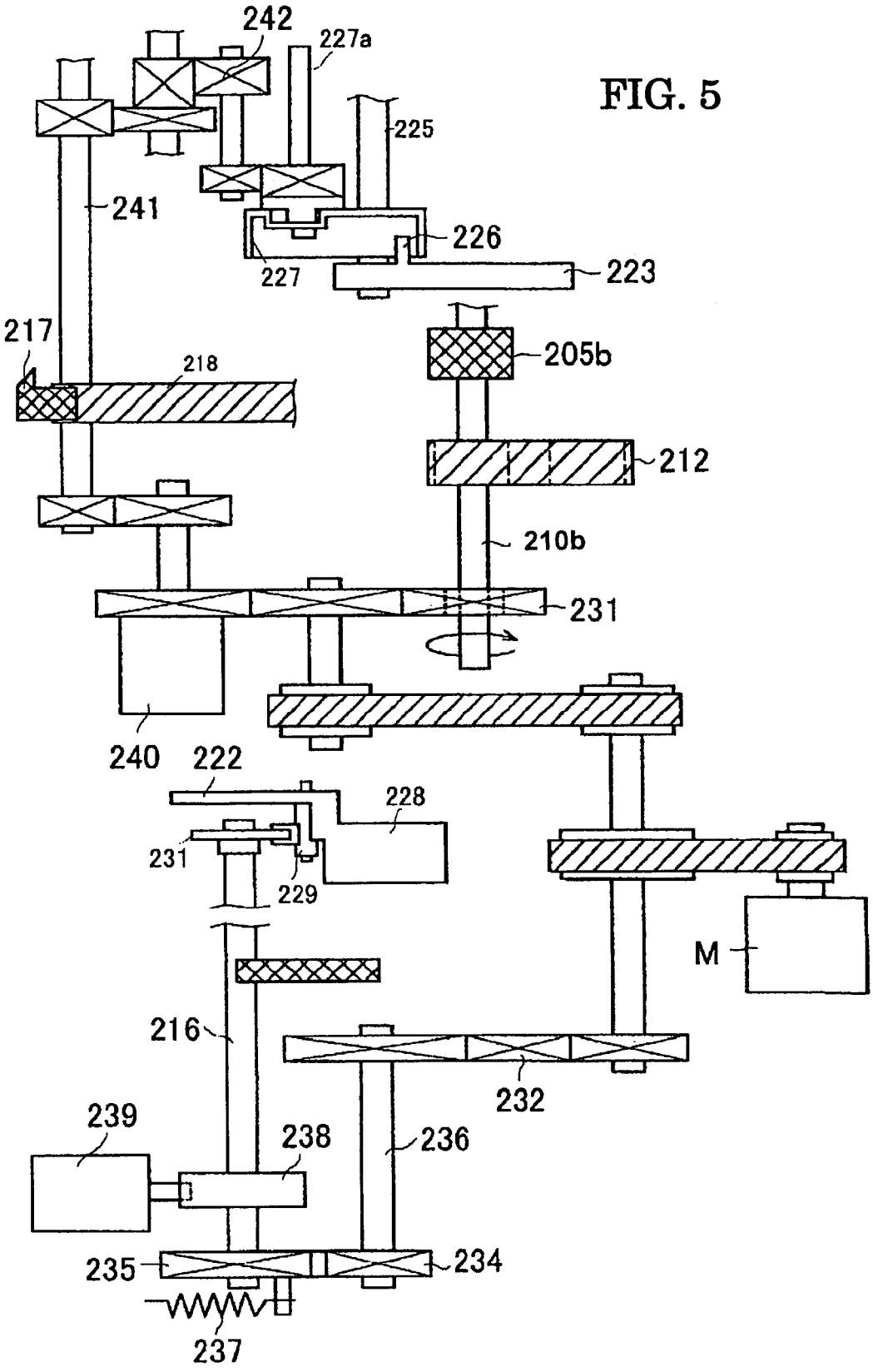
FIG. 5 is a schematic view showing a transmission system of the drive mechanism shown in FIG. 4.
Figure 6A:
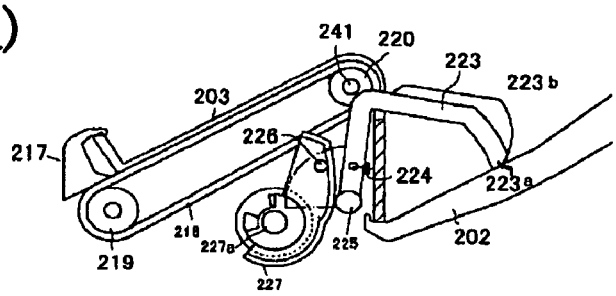
FIGS. 6(*a*) to 6(*d*) are views showing an operation of sheet pushing means shown in FIG. 1, wherein FIG. 6(*a*) shows a state that the sheet pushing means is located at a retracted position, FIG. 6(*b*) shows a state that the sheet pushing means moves away from the retracted position, FIG. 6(*c*) shows a state that the sheet pushing means is located at a transport position for transporting a sheet to a stacker, and FIG. 6(*d*) shows a state that the sheet pushing means pushes the sheet on the stacker.
Figure 6B:
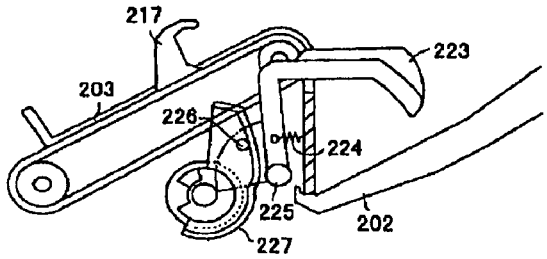
Figure 6C:
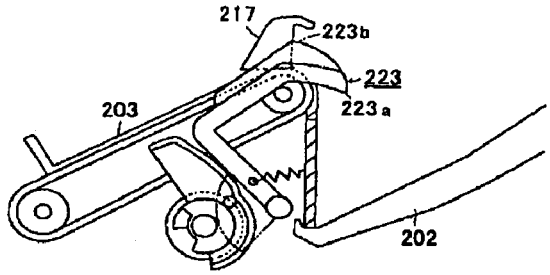
Figure 6D:
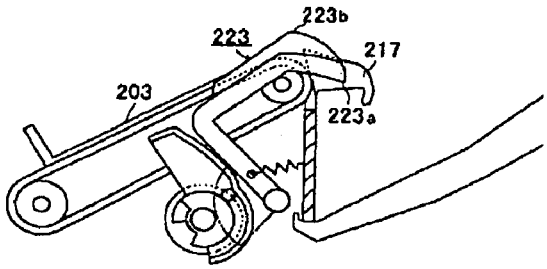

The cam 231 fastened to the rotating shaft 216 mounted with the paddle 215 touches the cam follower 230. The following shall describe the drive and control of the discharge roller 205, the discharge belt 212, the paddle 215, the sheet pushing member 217 and the sheet holder 223. As shown in FIG. 5, the rotation of the drive motor M capable of both forward and reverse rotations is transmitted to the rotating shaft 210*b* mounted with the discharge roller 205*b* and the discharge belt 212 via the transmission belt and the gears. The one-way clutch 231' is embedded between the rotating shaft 210*b* and the transmission gear mounted thereto. The rotation of the forward and reverse drive motor M is transmitted in one direction, i.e. the arrow direction in FIG. 5.

The configuration allows the drive to be transmitted to the rotating shaft 216 mounted with the paddle 215 via the transmission gear train 232, and the drive is intermittently transmitted to the gear 234 mounted to the intermediate shaft 236, and the gear 235 on the rotating shaft 216 mating with the gear 234. More specifically, the gear 235 is formed in a fan-shape, wherein one portion of an external circumference does not contact the gear 234.

The urging spring 237 is attached to the apparatus frame to rotate the fan-shaped gear 235 constantly in one direction. The latch wheel 238 and the solenoid 239 touching the wheel are equipped on the rotating shaft to check the rotation from the urging spring 237. By energizing the solenoid 239 to separate the actuator from the latch wheel 238, the rotating shaft 216 is rotated by the urging spring 237. This applies rotational force to the gear 235 mating with the gear 234 connected to, the drive motor M.

Constantly energizing the solenoid 239 in that state causes the rotating shaft to rotate once while slipping in contact with the outer circumference of the latch wheel and unmating the gears 234 and 235. The rotating shaft 216 is stopped by the urging spring 237. The cam 231 is mounted to the rotating shaft 216 to retract the paddle 215 and the full detection sensor 222. Therefore, the advancing of the leading edge of the sheet into the transport path 207 by the rotation of the drive motor M is detected by the sensor 221. The sheet is transported out from the discharge outlet 204 by the discharge roller 205*a* and the discharge belt 206. A signal from the sensor 221 energizes the solenoid 239 to rotate rotating shaft 216 after a predetermined amount of time.

When this occurs, the cam 231 rotates in the clockwise direction in FIG. 1, and rotates the cam follower 230 in the counterclockwise direction to retract the full detection sensor 222 unitized thereto above the support tray 203 centering around the rotating shaft 216. Along with the rotation of the rotating shaft, the paddle 215 mounted thereto also rotates in the clockwise direction to send the trailing edge of the sheet on the support tray 203 against the stopper wall 203*a*. Force from the drive motor M is transmitted by the gears to the rotating shaft 241 mounted with the pulley 220 of the motion belt 218 via the solenoid clutch 240.

The sheet pushing member 217 is attached to the motion belt 218. When the solenoid clutch 240 is connected, the rotation of the drive motor M is transmitted to the rotating shaft 241 to move the sheet pushing member 217 to the right side in FIG. 5. Reverse rotation of the drive motor M causes the sheet pushing member 217 to move to the left side in the FIG. 5. The cam 227 of the sheet holder 223 is connected to the rotating shaft 241 via the gear train 242. Along with the rotation of the rotating shaft 241, the cam 227 moves the sheet pushing member 217 from the sheet pushing position to the retracted position in the order shown in FIGS. 6(*a*) to 6(*d*).

If the drive motor M is rotated in reverse at this point, the rotation is not transmitted to the rotating shaft 216 of the paddle 241 because the gears 234 and 235 are not in contact. The one-way clutch 231' idles so the rotation is also not transmitted to the discharge rollers 205*a* and 205*b* and the discharge belt 212. The rotational drive is applied in the reverse direction to the rotating shaft 241, and the motion belt 218 and sheet holder 223 are recovered in the order shown in FIGS. 6(*d*) to 6(*a*).

To describe the configuration of the sheet pushing member 217, the sheet pushing member 217 is formed of a protruding member having the sheet touching surface 217*a* and the sheet pushing surface 217*b* as describe above, and is fastened to the motion belt 218. It is configured to reciprocally move over the support tray 203, and the drawings show the following configuration in particular.

The sheet pushing member 217 is set to be stationary at the retracted position retracted from the stopper wall 203*a* of the support tray 203 slightly toward the outside (see the position shown in FIG. 6(*a*)). A limit sensor (not shown) is also disposed at the position to detect the sheet pushing member 217. Shown in the drawing, separate from the sheet pushing member 217, the stopper wall 203*a* is equipped to align the trailing edge of the sheets on the support tray 203, and it is also perfectly acceptable to align the trailing edge of the sheets on the support tray 203 directly by using the sheet pushing member 217. The solenoid clutch 240 is connected to the sheet pushing member 217 to transmit the drive force of the drive motor N to the rotating shaft 241 with the processing end signal from the sheet finishing means 250. Along with the rotation of the rotating shaft 241, the motion belt 218 moves the sheet pushing member 217 from the state shown in FIG. 6(*a*) to the transport position shown in FIG. 6(*d*) to store the sheets on the support tray 203 in the stacker 202.

The leading edge of the sheet pushing member 217 is set to a positional relationship to press the uppermost sheet on the stacker 202 at the transport position. Therefore, when storing the sheets in the stacker 202, the sheet holder 223 retracts to the state shown in FIG. 6(*d*). Accordingly, the leading edge of the sheet pushing member 217 holds the sheets, so that they do not become disorderly.

The following shall describe the invention in the actions that occur when the mode to cause the finishing of the sheets such as stapling is set on the system configuration of the image forming unit 100 and the sheet finishing unit 200 mounted thereto.

The sheets with the images formed by the printing means 140 on the image forming unit 100 are led to the discharge path 160 and then sequentially guided to the linking path 162 via a switching gate. The switching gate 170 is positioned to guide the sheets to the linking path 162 in the mode. The sheets are transported out from the discharge outlet 204 through the transport path 207 of the sheet finishing unit 200. In this process, the leading edge of the sheet activates the sensor level 221*a*. This is detected by the sensor 221 to detect the arrival timing of the leading edge of the sheet to control the subsequent operations. The drive motor M is controlled to rotate the discharge roller 205*b* and the discharge belt 206 in the sheet discharge direction with the timing from the image forming unit 100.

Along with the rotation of the discharge roller 205*b* and the discharge belt 206, the sheet is sent to the right side in FIG. 1, and the leading edge of the sheet is moved along the support tray 203. When the sensor lever 221*a* detects the trailing edge of the sheet (as it passes through), the solenoid 239 is actuated after a predetermined amount of time after that timing, and the joining of the rotating shaft 216 and latch wheel 238 is released. The rotating shaft 216 is rotated for a predetermined amount by the urging spring 237. This causes the gear 235 mounted to the rotating shaft 216 to mate with the gear 234 connected to the drive motor M for transmitting the rotation of the drive motor N to the gear 234. In turn, the paddle 215 mounted thereto rotates in the clockwise direction in FIG. 1. The leading edge of the paddle 215 touches the sheet on the support tray 203 and moves it to the left side in FIG. 1, and the timing is set for the actuation of the solenoid 239 to touch the sheet after the trailing edge is completely transported out of the top of support tray 203 from the discharge belt 206.

At the same time when the rotating shaft 216 rotates, the cam 231 attached thereto touches the cam follower 230 and swings the full detection lever 222 in the clockwise direction in FIG. 1. With that timing, the lever is set to be retracted from the support tray 203 upwardly before the leading edge of the sheet advances into the support tray 203 and strikes the full detection lever 222. Specifically, the solenoid 239 is activated for a predetermined amount of time after the cam 231 on the rotating shaft 216 retracts the detection lever 222 above the support tray 203 before the leading edge of the sheet reaches the full detection lever 222 using the timing relating to when the sensor lever 221*a* detects the leading edge of the sheet.

After the trailing edge of the sheet of the maximum size is discharged to the support tray 203, the paddle 215 on the rotating shaft 216 touches the sheet on the support tray 203 and has a positional relationship to move the sheet in the left direction in FIG. 1. The trailing edge of the sheet moved by the paddle 215 advances between the discharge belt 206 and the support tray 203, then the rotation of the belt 206 pushes the trailing edge of the sheet to the stopper wall 203*a* where it stops. In this way, the sheet from the discharge outlet 204 is stacked on the support tray 203 and the aligning member 219' moves for a predetermined amount in the front to back direction in FIG. 1 (direction perpendicular to the sheet transport direction) to align the sheet. The operations are sequentially repeated so that the sheets are stacked on the support tray 203.

When the predetermined number of the sheets is stacked, a judgment is made according to the end signal sent from the image forming unit 100 or if the next sheet does not arrive at the sensor lever 221*a* within a predetermined amount of time. After the process end signal from the sheet finishing unit 200 or a predetermined amount of time after the process stops, the solenoid clutch 240 connected to the drive motor M is activated to transmit the rotation of the drive motor to the rotating shaft 241. This rotates the pulley 219 mounted to the rotating shaft 241 and causes the motion belt 218 to rotate in the clockwise direction. The sheet pushing member 217 then is moved from the retracted position to the right side in FIG. 1.

Along with this movement of the sheet pushing member 217, the sheets finished on the support tray 203 are gradually pushed to move to the stacker 202. The cam 227 connected to the rotating shaft 241 at this time by the gear train 242 touches the cam follower pin 226 to swing the sheet holder 223 in the clockwise direction around the shaft 225 to retract the sheet holder 223 from above the stacker 202. The sheet pushing member 217 pushes the sheets on the support tray 203 to the stacker 202 with the retraction of the sheet holder 223 from the stacker 202 and the forward and backward movements. The leading edge of the sheet pushing member 217 presses the uppermost sheet of the sheets stacked in the stacker 202 downwardly.

To describe the actions in reference to FIGS. 6(*a*) to 6(*d*), the solenoid clutch 240 is activated in the state shown in FIG. 6(*a*) with the sheet pushing member 217 positioned at the retracted position to move to the position shown in FIG. 6(*b*) when the rotating shaft 241 rotates. In the state shown in FIG. 6(*b*), the cam 227 touches the cam follower pin 226 to retract the sheet holder 223 above the stacker 202. Also, along with the rotation of the rotating shaft 241, the sheet holder 223 is retracted to a position where it protrudes above the support tray 203 shown in FIG. 6(*c*) and FIG. 6(*d*) to bend the sheet transported out in the direction perpendicular to the transport direction. By bending the sheet in the direction perpendicular to the transport direction, the transporting force of the sheet pushing member 217 is transmitted to the sheet to provide the sheet with a force to exit into the stacker 202.

When the sheet pushing member 217 is positioned at the transport position shown in FIG. 6(*a*), the leading edge of the sheet pushing member 217 presses the sheets in the stacker 202 in place of the sheet holder 223 downwardly to hold the stacked sheets. A limit switch is equipped at the retracted position on the sheet pushing member 217. With the movement from the position, a control signal of the reverse rotation is issued to the drive motor M at the transport position where a control pulse of the drive motor M reaches a predetermined pulse count to cause the drive motor to rotate in reverse. With the reverse rotation of the drive motor M, the sheet holder 223 moves (recovers) to the direction to press the sheets on the stacker 202 from the position shown in FIG. 6(*d*), to the position shown in FIG. 6(*c*), and then to the position shown in FIG. 6(*b*) in that order.

At the same time, the sheet pushing member 217 also recovers along the support tray 203 in the order of FIGS. 6(*d*) to 6(*b*). The limit switch detects when the sheet pushing member 217 is recovered to the retracted position and a signal sent from the switch stops the drive motor M. The solenoid clutch 240 is then stopped and the system is set in the initial state. Then, the same action is repeated to wait for a discharge out of the sheets from the image forming unit 100. In the process, the sheet pushing member 217 reciprocates between the retracted and transport positions on the support tray 203. As compared to a conventional apparatus in which a pushing member revolves around an endless belt, the space for the movement is notable reduced.

As describe above, the sheet pushing member 217 is configured to reciprocally move in the forward and reverse directions between the retracted position and the transport position. Accordingly, as compared to the conventional apparatus in which a pushing member revolves around a support tray, a space for the sheet pushing member is conserved. The drive mechanism is simplified to enable a more compact apparatus. Also, there is no concern that the sheets stacked in the stacker get caught up in the mechanisms of the apparatus by the sheet pushing member. It is also possible to orderly stack the sheets in the stacker by setting the transport position of the sheet pushing member at the position to press the uppermost sheet in the stacker.

The following will explain the sheet holder 223 that functions as a sheet bending member to securely discharge the sheets from aligning means 219' that align the sheets and from the support tray 203. As shown in FIG. 1 and FIG. 3, the aligning means 219' are disposed on the support tray 203 and are formed in a plate-shape for touching the side edges of the sheets (in the direction perpendicular to the transport direction). The aligning means 219' are disposed in a pair at the left and right sides of the sheet edges. When aligning the sheets based on the center, the aligning means 219' at the left and right sides are configured to move for an equal distance and to align the sheets at a predetermined position. To align one side of the sheets (using a side reference), at least one of the aligning means 219' is set to be stationary and the other is configured to move. Shown in the drawings is a side reference version. The aligning means 219' are configured of movable plate-shaped aligning plates 219' for touching at least the central side of the sheets on the support tray 203 and reference walls (not shown) unitized to the support tray 203.

The movable aligning plate 219' is provided with a rack gear on the backside (opposite side of the sheet stacking surface) of the support tray 203. A pinion that mates with the rack is connected to a pulse motor capable of both forward and reverse rotations. Therefore, when the pulse motor rotates in the forward and reverse directions, the movable aligning means 219' reciprocally move for a predetermined amount. This aligns the sheets on the support tray 203 in the width direction against the fixed reference wall. Note that the pulse motor is set to operate after a predetermined amount of time (after the sheets are stacked on the support tray) from the timing signal when the leading or trailing edge of the sheet is detected by the sensor 221 in the transport path 207 as described above.

The sheet holder 223 that functions as the sheet bending member is disposed movably between a position that protrudes upwardly from the support tray 203 and a retracted position at the same surface as the stacking surface of the support tray 203 or separated therefrom. One or a plurality of the sheet bending members can be disposed in the sheet width direction (in a direction perpendicular to the sheet transport direction) to bend the sheets stacked on the support tray 203 in the direction perpendicular to the sheet transport direction. Shown in the drawings is the sheet bending member 223 operating as the sheet holder 223 on the stacker 202. It is acceptable to mount a sheet bending member to the support tray 203 as an independent part, or to have it dual as the sheet pushing member, as shown in the drawings, or to dual with other functioning parts as well.

Figure 4:
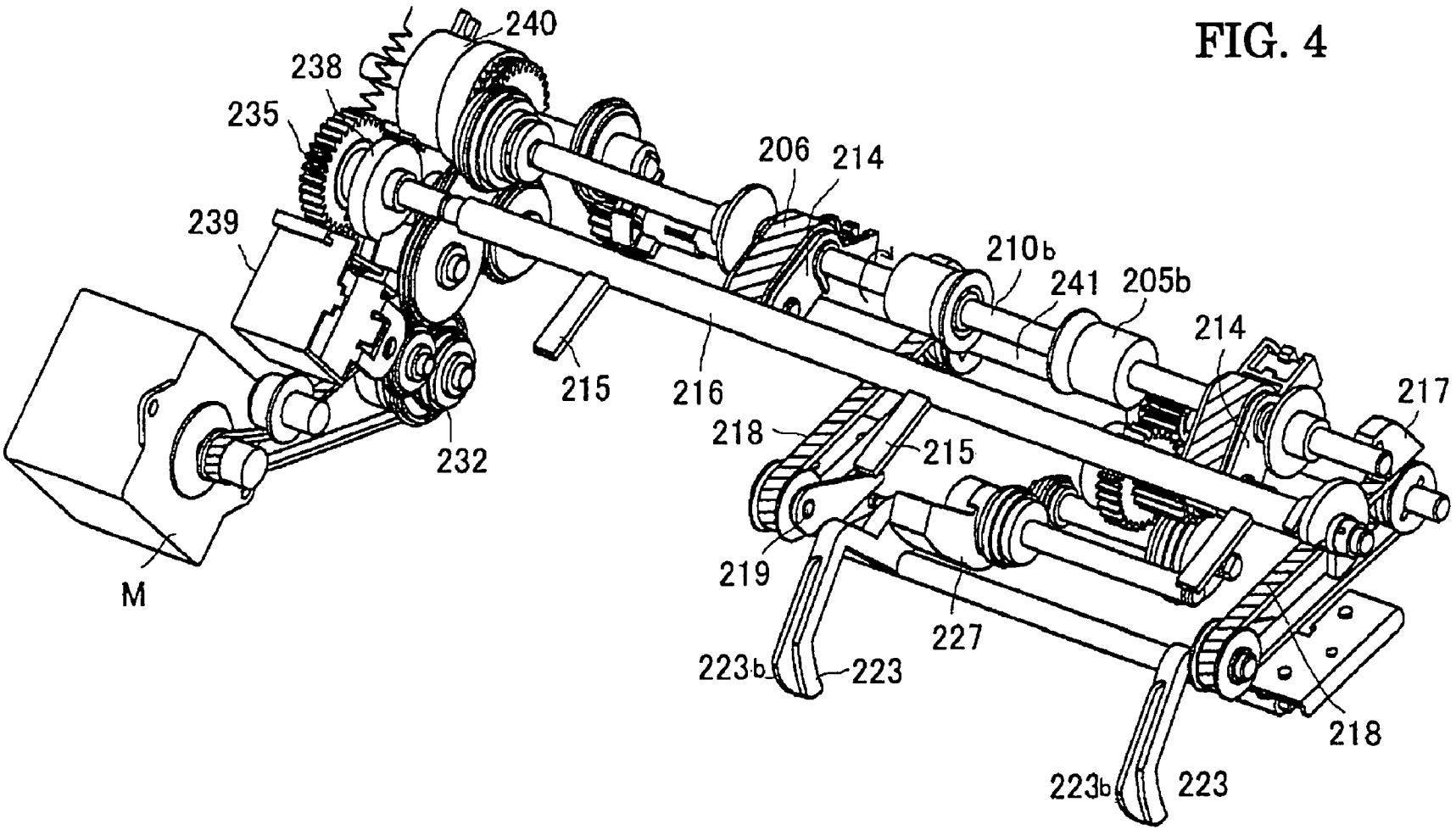
FIG. 4 is a perspective view showing a drive mechanism of the sheet stacking apparatus according to the embodiment of the present invention.

To describe the configuration of the sheet holders 223 shown in the drawing as the sheet bending member, the sheet holders 223 are equipped to swing around the shaft 225 above the stacker 202. The sheet pushing members in the drawings are composed of arm-shaped members at two locations in the sheet width direction as shown in FIG. 4. The positions and the shape are set to apply the optimum bend to the sheets using the members. The leading edge pushing portion 223*a* of the arm-shaped sheet holder 223 is constantly urged to press the sheets on the stacker 202 by the urging spring 224. A cam follower pin 226 is unitized to the sheet holder 223 to touch a cam 227.

The cam 227 is mounted on the rotating shaft 227*a* as shown in FIGS. 6(*a*) to 6(*d*). With the rotation of the rotating shaft 227*a*, the sheet holder 223 moves above the stacker 202 against the force of the urging spring 224. Specifically, the sheet holder 223 is configured to move by the cam 227 between the position retracted below the support tray 203 (as shown in FIGS. 6(*a*) and 6(*b*)) to a position protruding above the support tray 203 (as shown in FIGS. 6(*c*) and 6(*d*)). The movement progresses in the order shown in FIGS. 6(*a*) to 6(*d*).

The following shall describe the actions of the aligning means 219' and the sheet holders 223. The sheets from the image forming unit 100 are transported out to the discharge outlet 204 through the transport path 207 of the sheet finishing unit 200. In this process, the leading edge of the sheet activates the sensor level 221*a*. This is detected by the sensor 221 to detect the arrival timing of the leading edge of the sheet to control the subsequent operations. The drive motor M is controlled to rotate the discharge roller 205*b* and the discharge belt 206 in the sheet discharge direction with the timing from the image forming unit 100. Along with the rotation of the discharge roller 205*b* and the discharge belt 206, the sheet is sent to the right side in FIG. 1, and the leading edge of the sheet is moved along the support tray 203.

When the sensor lever 221*a* detects the trailing edge of the sheet (as it passes through), the solenoid 239 is actuated after a predetermined amount of time, and the joining of the rotating shaft 216 and latch wheel 238 is released. The rotating shaft 216 is rotated for a predetermined amount by the urging spring 237. This causes the gear 235 mounted to the rotating shaft 216 to mate with the gear 234 connected to the drive motor M that transmits the rotation of the drive motor M to the gear 216. This causes the paddle 215 mounted thereto to rotate in the clockwise direction in FIG. 1. The leading edge of the paddle 215 touches the sheet on the support tray 203 and moves it to the left side in FIG. 1, and the timing is set for the actuation of the solenoid 239 to touch the sheet after the trailing edge is completely transported out of the top of support tray 203 from the discharge belt 206.

At the same time that the rotating shaft 216 rotates, the cam 231 attached thereto touches the cam follower 230 and swings the full detection lever 222 in the clockwise direction in FIG. 1. However, with that timing, the lever is set to be retracted from the support tray 203 upwardly before the leading edge of the sheet advances into the support tray 203 and strikes the full detection lever 222. Specifically, the solenoid 239 is activated for a predetermined amount of time after the cam 231 on the rotating shaft 216 retracts the detection lever 222 above the support tray 203 before the leading edge of the sheet reaches the full detection lever 222 using the timing of when the sensor lever 221*a* detects the leading edge of the sheet.

After the trailing edge of the sheet of the maximum size is discharged to the support tray 203, the paddle 215 on the rotating shaft 216 touches the sheet on the support tray 203 and has a positional relationship to move the sheet in the left direction in FIG. 1. The trailing edge of the sheet moved by the paddle 215 advances between the discharge belt 206 and the support tray 203, then the rotation of the belt 206 pushes the trailing edge of the sheet to the stopper wall 203*a* where it stops. In this way, the sheet from the discharge outlet 204 is stacked on the support tray 203, and the aligning member 219' moves for a predetermined amount in the front to back direction in FIG. 1 (direction perpendicular to the sheet transport direction) to align the width direction of the sheets. The sheet is positioned at a predetermined position on the stacking surface of the support tray.

Next, the same operations are repeated to stack the sheets on the support tray 203. When the predetermined number of the sheets is stacked, a judgment is made according to the end signal sent from the image forming unit 100 or if the next sheet does not arrive at the sensor lever 221*a* within a predetermined amount of time. After the process end signal from the sheet finishing unit 200 or a predetermined amount time after the process stops, the solenoid clutch 240 connected to the drive motor M is activated to transmit the rotation of the drive motor to the rotating shaft 241. This rotates the pulley 219 mounted to the rotating shaft 241 and causes the motion belt 218 to rotate in the clockwise direction. The sheet pushing member 217 then is moved from the retracted position to the right side in FIG. 1.

Along with this movement of the sheet pushing member 217, the sheets finished on the support tray 203 are gradually pushed to move to the stacker 202. The cam 227 connected to the rotating shaft 241 by the gear train 242 touches the cam follower pin 226 to swing the sheet holder 223 in the clockwise direction around the shaft 225 to retract the sheet pushing member 217 from the stacker 202. The sheet pushing member 217 pushes the sheets on the support tray 203 to the stacker 202 with the retraction of the sheet holder 223 from the stacker 202 and the forward and backward movements. The leading edge of the sheet pushing member 217 presses the uppermost sheet surface of the sheets stacked in the stacker 202 downwardly.

To describe the actions in reference to FIGS. 6(*a*) to 6(*d*), the solenoid clutch 240 is activated in the state shown in FIG. 6(*a*) with the sheet pushing member 217 positioned at the retracted position to move it to the position shown in FIG. 6(*b*) when the rotating shaft 241 rotates. At the same time, the rotating shaft 227*a* connected via the rotating shaft 241 and gear train 242 rotates in synchronization. In the state shown in FIG. 6(*b*), the rotating shaft 227*a* touches the cam follower pin 226 to retract the sheet holder 223 above the stacker 202. Also, along with the rotation of the rotating shaft 241, the sheet holder 223 is retracted to a position where it protrudes above the support tray 203 as shown in FIG. 6(*c*) and FIG. 6(*d*) to bend the sheet transported out in the direction perpendicular to the transport direction. By bending the sheet in the direction perpendicular to the transport direction, the transporting force of the sheet pushing member 217 is transmitted to the sheet to provide the sheet with a force to exit into the stacker 202.

When the sheet pushing member 217 is positioned at the transport position shown in FIG. 6(*a*), the leading edge of the sheet pushing member 217 presses the sheets in the stacker 202 in place of the sheet holder 223 downwardly to hold the stacked sheets. A limit switch is equipped at the retracted position on the sheet pushing member 217. With the movement from this position, a control signal of the reverse rotation is issued to the drive motor M at the transport position where the control pulse of the drive motor M reaches a predetermined pulse count to cause the drive motor to rotate in reverse. With the reverse rotation of the drive motor M, the sheet holder 223 moves (recovers) to the direction to press the sheets on the stacker 202 from the position shown in FIG. 6(*d*), to the position shown in FIG. 6(*c*), and then to the position shown in FIG. 6(*b*) in that order.

In other words, according to the invention, as described above, the aligning means is used to position the sheet bending member between the protruding position where it forms a bend in the sheets stacked on the support tray, and the retracted position away from the sheets. When aligning, it is positioned at the retracted position, and when the sheets are transported out, it is positioned at the protruding position. This bends the sheets when they are transported to securely discharge them to the stacker. When aligning the sheets, they are not bent, so that it is possible to correctly align them in the support tray. The sheet bending member is configured to press the sheets stacked on the stacker at the retracted position. Accordingly, it is possible to securely transport with it protruding in the support tray when discharging the sheets while holding the sheets on the stacker.

The following shall describe the full detection lever that touches the uppermost sheet discharged to the top of the stacker 202 to detect the amount of the sheets stacked, according to the embodiment of the present invention. The stacker 202 is composed of a tray for stacking normal sheets, and is mounted to the frame of the sheet finishing unit 200. To the stacker 202 are adjacently equipped the support tray 203 at a position that forms a level that corresponds to the maximum amount of the sheets, and the discharge means for transporting the sheets along the support tray 203 used as a transport guide.

In the drawings, the transport path 207 and the discharge outlet 204 are provided with a level therebetween at an upstream side of the support tray 203 as transport guides. The sheet discharge means comprising the discharge rollers 205 and discharge belt 206 is disposed at the discharge outlet 204. The sheets fed sequentially from the image forming unit 100 are sent to the support tray 203 that functions as a transport guide from the discharge outlet 204 in the transport path 207 with the discharge roller 205*a* and the discharge belt 206 as the sheet discharge means. Then, the sheet is transported out to the top of the stacker 202 by the sheet pushing member 217 used as the discharge means along the discharge guide.

In this configuration, as shown in FIG. 1, the full detection lever 222 detects the amount of the sheets stacked in the stacker 202 by touching the uppermost sheet, and lowers downwardly from above the stacker to go beyond a movement path of the sheets from the support tray 203 to the stacker 202. At the same time, the full detection lever 222 lowers from the position passing the movement path of the sheets from the discharge outlet 204 to the support tray 203. As shown in FIG. 1, the base of the lever member is rotatably supported on the shaft 229 disposed above the stacker 202.

The plate-shaped actuator 228*a* and cam follower 230 are unitized to the full detection lever 222. The detection lever 222, actuator 228*a* and cam follower 230 are unitized rotatably around the shaft 229. These three parts urge the full detection lever 222 to constantly touch the stacker 202 with its own weight. The actuator 228*a* detects a state that the detection sensor 228 engages the full detection sensor 222 upon the predetermined maximum capacity.

The cam follower 230 unitized with the full detection lever 222 is configured to touch the cam 231 attached to the rotating shaft 216 of the paddle 215. The rotating action of the cam 231 retracts the full detection lever 222 above the stacker 202. Specifically, the rotating shaft 216 mounted with the cam 231 is connected to the drive motor M via the fan-shaped gear 235, gear 234, intermediate shaft 236 and transmission gear train 232. At the same time, the latch wheel 238 and the urging spring 237 are equipped on the rotating shaft 216, and the solenoid 239 touches the latch, wheel 238. The latch wheel 238 stops the rotating shaft 216 in a state that the latch wheel 238 engages the actuator of the solenoid 239. Then, the fan-shaped gear 235 and gear 234 on the intermediate shaft 236 are placed in a non-contact state. The cam 231 on the rotating shaft 216 is placed as shown in FIG. 1. In other words, the cam 231 and cam follower 230 are in a non-contact state at the home position where the rotating shaft 216 is stopped, and the cam follower 230 can rotate freely by a predetermined angle around the rotating shaft 229.

Therefore, the full detection lever 222 can rotate freely by a predetermined angle at the home position where the rotating shaft 216 is stopped by the solenoid 239. The full detection lever 222 rotates around the rotating shaft 229 with the leading edge thereof following the amount of the sheets stacked on the stacker 202. The actuator 228*a* unitized to the full detection lever 222 activates the detection sensor 228 to make it possible to ascertain that the predetermined number of the sheets is stacked.

Figure 8:
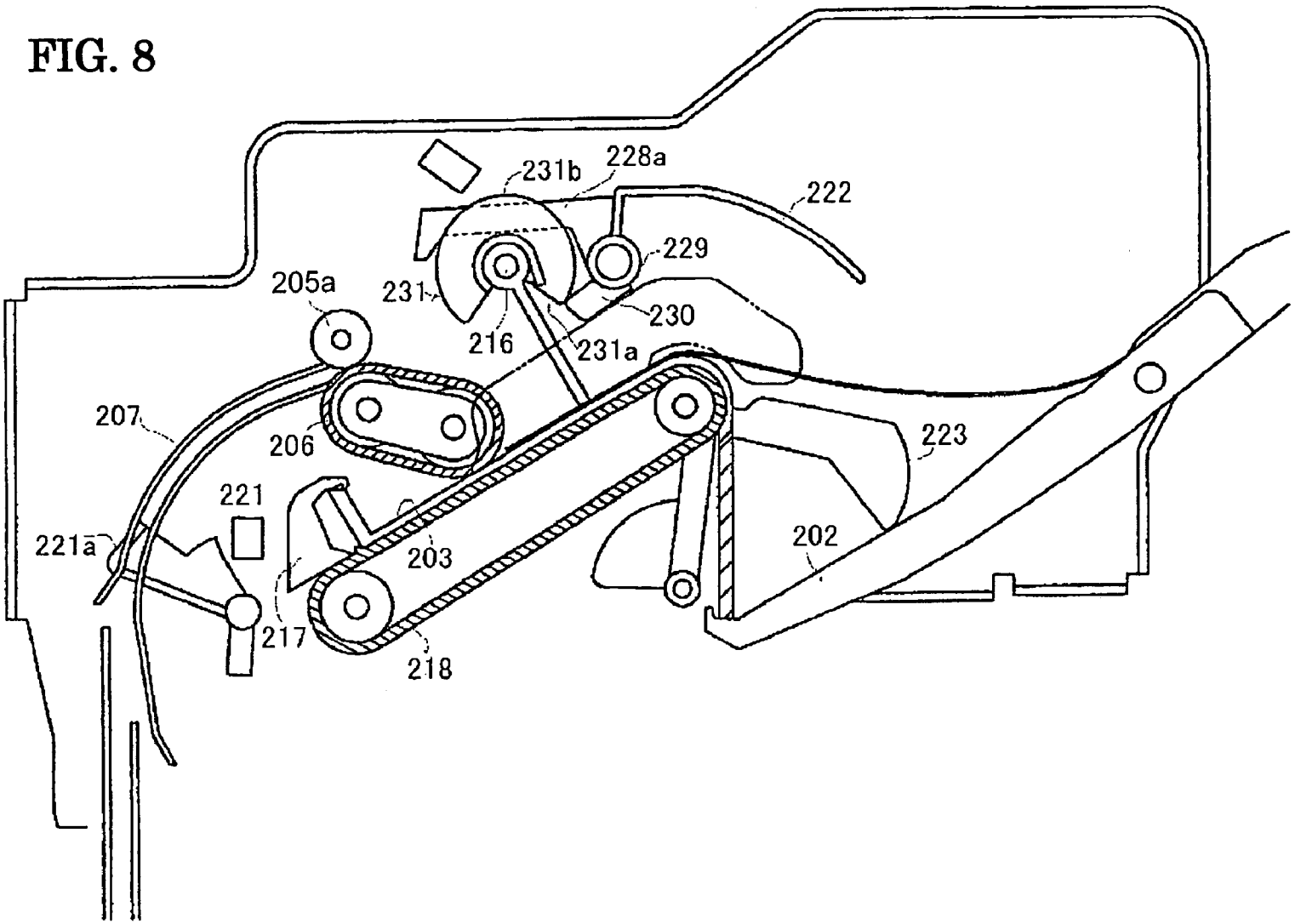
Figure 9:
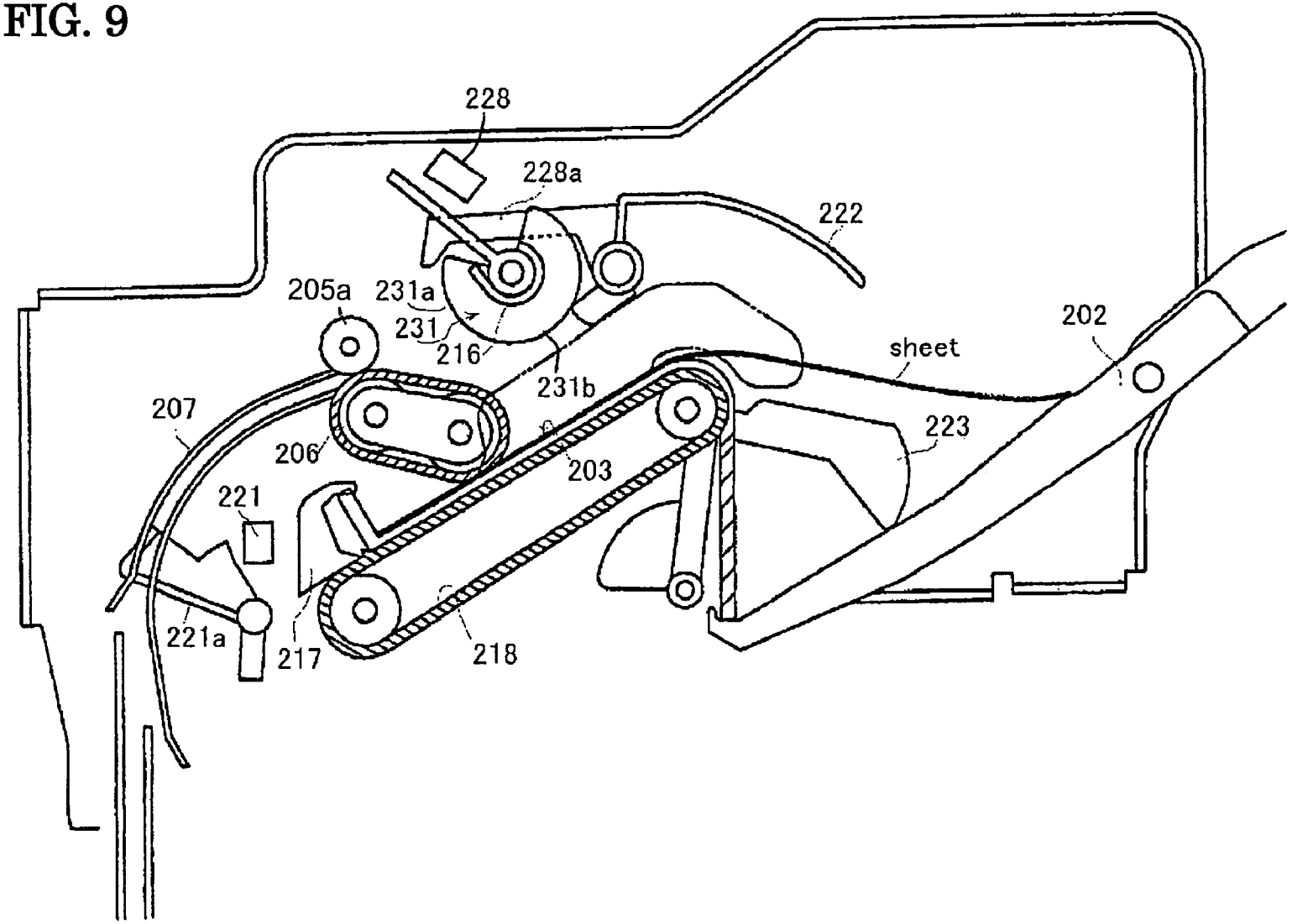

The following shall describe the actions of the sheet finishing apparatus with reference to FIGS. 6(*a*) to 6(*d*) to FIG. 8. The sheets formed with images by the printing means 140 in the image forming unit 100 are lead to the discharge path 160. At this point, if the operating mode for finishing the sheets is selected, the switching gate 170 switches the position to feed the sheets to the linking path 162. The sheets from the linking path 162 are thus lead and transported out to the discharge outlet 204 by the transport means, i.e. the discharge roller 205*a* and the discharge belt 206, in the transport path 207 of the sheet finishing unit 200. In this process, the leading edge of the sheet activates the sensor level 221*a*. This is detected by the sensor 221 to control subsequent operations with this timing signal.

At this time, the drive motor M described above starts rotating with a signal from the image forming unit 100 to drive the discharge means to rotate in the sheet transport direction. Along with the rotation of the discharge means, the sheet is sent to the right side in FIG. 1, and the leading edge of the sheet is moved along the support tray 203.

Next, the solenoid 239 is activated after a predetermined amount of time by the delay means such as a timer with the signal from the sensor 221 for detecting the leading edge of the sheet. The action of the solenoid 239 causes the actuator to separate with the latch wheel on the rotating shaft 216, and the rotating shaft 216 is rotated by a predetermined angle by the urging spring 237. Accordingly, the fan-shaped gear 235 on the rotating shaft 216 mates with the gear 234 connected with the drive motor M and is rotating to transmit the rotation of the drive motor M to the rotating shaft 216. The rotating shaft 216 rotates from the home position where it is stopped in FIG. 1 and in FIGS. 6(*a*) to 6(*d*) in the clockwise direction. The cam 231 also rotates in the same direction in FIG. 7. With the rotation of the cam 231, the cam follower 230 swings the full detection lever 222 in the counterclockwise direction in FIG. 7 around the shaft 229 using the cam surface 231*a*.

The leading edge of the full detection lever 222 is positioned at the retracted position away from the movement path of the sheets along the support tray 203. Next, the paddle 215 mounted to the rotating shaft 216 moves the sheets to the left side in FIG. 7 along the support tray 203, and aligns the sheets stacked on the support tray 203 as shown in FIG. 8 along with the rotation in the clockwise direction of the rotating shaft 216. In this process, the cam follower 230 on the full detection lever 222 slides on the cam surface 231*b* on the cam 231 to hold it in the retracted position (angle) away from the movement path of the sheets above the stacker 202.

To describe the actions according to the states shown in FIGS. 1, 6(*a*) to 6(*d*), 7, and 8, the drive motor M in the sheet finishing unit 200 starts rotating when the sheet discharge signal is received from the image forming unit 100. The rotation of the drive motor M is transmitted to the rotating shaft 210 to rotate the discharge roller 205*b* and discharge belt 206 that comprise the sheet discharge means to discharge the sheet to the right side in FIG. 1. At this time, the solenoid touches the latch wheel 238 to stop the rotating shaft 216 that is mounted with the paddle 215 and cam 231. The transmission of the drive motor M and rotating shaft 216 is continued while the fan-shaped gear 235 and the gears on the intermediate shaft 236 do not contact.

When the sheet advances into the transport path 207, the lever 221*a* on the sensor 221 shown in FIGS. 6(*a*) to 6(*d*) detects the leading edge of the sheet to detect the timing for the leading edge of the sheet to reach the lever position. An energizing signal is emitted from the control circuit to the solenoid 239 at the appropriate timing before the leading edge of the sheet reaches the full detection lever 222 from the activating signal of the sensor 221. This releases the solenoid 239 from the latch wheel to allow the rotating shaft 216 to rotate freely (unconstrained). Then, the rotating shaft 216 is urged to rotate by the urging spring 237 to mate the fan-shaped gear 235 with the gear 234 on the intermediate shaft 214. The rotation of the drive motor M is transmitted to the rotating shaft 216 via the gear train 232 and intermediate shaft 236 to start rotating in the clockwise direction in FIGS. 6(*a*) to 6(*d*). The cam 231 and the paddle 215 rotate in the clockwise direction in FIGS. 6(*a*) to 6(*d*) with the rotation of the rotating shaft 216. This causes the cam surface 231*a* to touch the cam follower 230 and rotate in the counterclockwise direction around the shaft 229. This moves the full detection lever 222 to the retracted position above the stacker as shown in FIG. 7. In this state, the sheet advances over the support tray 203, and the leading edge of the sheet reaches the stacker 202.

The paddle 215, as shown in FIG. 7, moves in the reverse direction, to the left in the drawing, which is reverse to the sheet transport direction when the sheet is completely discharged from the support tray 203. The sheet stops at the aligned position with its trailing edge abutting against the protruding portion on the support tray 203. Then, the paddle 215 separates from the sheet and rotates in the clockwise direction along with the rotating shaft 216, as shown in FIG. 8. The cam 231 constantly holds the full detection lever 222 in the retracted position with the outer circumference cam surface 231*b* pressing the cam follower 230.

Then, when the rotating shaft 216 rotates once, the actuator on the solenoid 239 touches the latch wheel 238 to stop the rotating shaft 216. This causes the fan-shaped gear 235 and the gear 234 on the intermediate shaft to become a non-contact state and return to the state shown in FIG. 1. The cam 231 and cam follower 230 do not contact, so that the full detection lever 222 falls under its own weight to the stacker 202 side and holds the sheets transported out from the support tray 203.

By repeating these operations, the sheets are sequentially stacked on the support tray 203. When a predetermined number of the sheets are stacked on the support tray 203 and the operation end signal is received from the image forming unit 100, the sheet finishing means 250 finishes the sheets stacked on the support tray 203 by stapling the sheet bundle. When the operation end signal is received from the sheet finishing means 250, that the solenoid clutch 240 transmits the rotation of the drive motor to the rotating shaft 241 (see FIG. 5). When this occurs, the pulley 219 mounted to the rotating shaft 241 rotates the endless belt 218 in the clockwise direction in FIG. 1. The sheet pushing member 217 attached to the endless belt 218 pushes the sheet bundle out from the support tray 203 to the right in FIG. 8. Therefore, the sheet pushing member 217 is composes the sheet discharge means on the support tray 203.

The sheets pushed out from the support tray 203 are stacked on the stacker 202. The full detection lever 222 touches the uppermost sheet stacked on the stacker 202. After the discharge operation of the sheet pushing member 217 is completed, a signal of the status of the sensor 228 is received at an appropriate timing to determine that the stacker 202 is full of the sheets. Specifically, the sensor 228 is activated by the actuator 228*a* and the activating state is set to be the position where the stacker 202 is full of the sheets.

Note that the descriptions above describe the operations when the sheets are stacked on the support tray 203. It is also perfectly acceptable to transport the sheets out sequentially to the stacker 202 without stacking them on the support tray 203. In that case, in the state shown in FIG. 8, the full detection lever 222 is held at the retracted position by the cam 231 and the sheet pushing member (discharge means) can be activated to push the sheets on the support tray 203 out to the stacker 202.

In other words, the detection lever that detects the amount of the sheets stacked on the stacker is composed in the following way. Specifically, the sheet stacking apparatus is equipped with the sheet transport means for sequentially transporting the sheets; the support tray that temporarily stacks the sheets from the sheet transport means and also functions as the transport guide; the discharge means for discharging the sheets on the support tray; the stacker arranged below the discharge means; the sheet height detection lever that touches the uppermost sheet in the stacker; and the, detection sensor for detecting the position of the detection lever. The detection lever is configured to move freely between the retracted position above the movement path of the sheets from the sheet transport means to the transport guide, and the detecting position that touches the uppermost sheet on the stacker. Also connected to the detection lever in the sheet stacking apparatus is the moving means that hold the detection lever at the retracted position when the sheets are moved from the sheet transport means to the transport guide.

The configuration described above solves the problems of the conventional apparatus disclosed in U.S. Pat. No. 6,412,774. Specifically, as in the conventional apparatus, there is a structure for swinging a detection lever in a limited amount of space between a sheet advancing path and the uppermost sheet. However, if a curled sheet is transported in, it will become raised and stacked over the lever, thereby damaging the apparatus. Particularly in an apparatus that incorporate the stapled sheet bundles, the stapled portion of the sheets can touch the detecting position of the detection lever and cause frequent erroneous detections.

However, with the full detection lever of the embodiment described above, it is possible to detect the level of the sheets by pressing the sheets stacked in the stacker with the appropriate force. Moreover, even if the lever for detection is disposed at any position of the sheet, it is still possible to align and store the stapled sheet bundles or curled sheets without any hindrance. It is also possible to provide the sheet stacking apparatus that can correctly detect the level of the sheets. Also, the sheet finishing means is disposed in front the sheet stacking unit (sheet stacker) at a side that the sheet is transported. Accordingly, it is possible to provide an apparatus in which the sheet surface level detecting mechanism in the stacker does not affect the operations.

In other wards, it is possible to detect the amount of the sheets stacked at the center thereof, and to prevent erroneous or improper detections of the amount of the sheets caused by detecting the corners of the sheets partially enlarged because of stapling or curl. The detection lever is retracted and held above the transport path of the sheets when they are transported to the stacker, so it does not interfere with the sheets.

As described above, according to the present invention, the sheet stacking apparatus and image forming apparatus equipped with the same have the compact and simple structure with low cost, and the problem of the conventional large apparatus caused by the protruding member revolving around the endless belt is solved. Also, the invention solves the problem of the pushing member getting caught on the sheets because it moves toward the backside of the tray moving past the sheets stacked on the stacker after the trailing edge of the sheets is pushed to the stacker. If there is an excessive amount of the sheets stacked on the stacker, or the sheets are curled, it can cause the pushing member to caught, thereby damaging the apparatus or the sheets. Still further, the present invention enables the stacking of the aligned sheets by pushing the sheets on the stacker with the pushing member that conveys the sheets on the stacker.

Also, the present invention provides the sheet stacking apparatus that enables the secure conveyance of the sheets out from the temporary stacker and enables the secure alignment and discharge of the sheets without negatively affecting the sheet alignment.

While the invention has been explained with reference to the specific embodiments of the invention, the explanation is illustrative and the invention is limited only by the appended claims.

What is claimed is:

1. A sheet stacking apparatus comprising:

a sheet transport path for transporting a sheet, discharge means disposed at the sheet transport path for transporting the sheet, a support tray disposed adjacent to the discharge means for temporarily supporting at least a part of the sheet transported by the discharge means, a stacker disposed at a downstream side of the support tray in a sheet moving direction for stacking and storing the sheet transported from the support tray, a sheet pushing member disposed adjacent to the support tray and having a touching member protruding above the support tray for abutting against a trailing edge of the sheet stacked on the support tray, and drive means capable of rotating in forward and reverse directions, said drive means including a belt member with the sheet pushing member attached thereto for reciprocally moving the sheet pushing member between a retracted position at an upstream side of a stacking position where the sheet is stacked on the support tray and a transport position at a downstream side of the stacking position, and a drive motor attached to the belt member and moving the sheet pushing member from the retracted position to the transport position and returning the sheet pushing member in a reverse direction from the transport position to the retracted position, said sheet pushing member having a posture at the transport position so that the sheet transferred onto the stacker is pressed between the stacker and the sheet pushing member.

2. A sheet stacking apparatus according to claim 1, wherein said drive means moves the sheet pushing member from the transport position to the retracted position at a speed faster than a speed at which the drive means moves the sheet pushing member from the retracted position to the transport position.

3. A sheet stacking apparatus according to claim 1, further comprising finishing means for performing a finishing process on the sheet stacked on the support tray.

4. An image forming apparatus comprising the sheet stacking apparatus according to claim 1, image forming means for forming an image on the sheet, and sheet transport means for transporting the sheet from the image forming means.

5. A sheet stacking apparatus according to claim 1, wherein said discharge means includes a pair of pulleys pivotally arranged above the support tray, and a belt disposed around the pulleys so that the belt transfers the sheet onto the support tray, a part of the belt being always pushed onto the support tray by a pivotal arrangement of the pulleys.

6. A sheet stacking apparatus comprising:

a support tray for stacking a sheet, aligning means for pressing an edge of the sheet on the support tray at a predetermined position, a stacker disposed adjacent to the support tray at a downstream side in a sheet transfer direction for storing the sheet fed from the support tray, sheet discharge means for transporting the sheet on the support tray to the stacker, a sheet bending member disposed between the support tray and the stacker and located at the downstream side in the sheet discharge direction relative to the sheet discharge means, said sheet bending member capable of moving between a protruding position where the sheet bending member protrudes above the support tray from a lower side thereof to bend the sheet stacked on the support tray in a direction perpendicular to a direction that the sheet is transported and a pushing position where the sheet bending member contacts an uppermost sheet on the stacker, and drive means for moving the sheet bending member between the protruding position and the sheet pushing position.

7. A sheet stacking apparatus according to claim 6, wherein said drive means moves the sheet bending member from the sheet pushing position to the protruding position when the sheet discharge means transports the sheet on the support tray.

8. sheet stacking apparatus according to claim 6, wherein said sheet bending member is disposed on at lease one location on the support tray in a width direction of the sheet perpendicular to the direction that the sheet is transported.

9. A sheet stacking apparatus according to claim 6, wherein said sheet discharge means and sheet bending means have shapes abutting against the sheet at two positions in a width direction of the sheet perpendicular to the direction that the sheet is transported.

10. A sheet stacking apparatus according to claim 6, wherein said sheet discharge means and said sheet bending member are connected to same drive means, said drive means and said sheet bending member being connected together through a delay transmission mechanism.

11. An image forming apparatus comprising the sheet stacking apparatus according to claim 6, image forming means for forming an image on the sheet, and sheet transport means for transporting the sheet from the image forming means.

12. A sheet stacking apparatus according to claim 6, wherein said sheet discharging means includes a sheet pushing member disposed adjacent to the support tray and moving in a direction that the sheet is discharged, said sheet pushing member having a posture at a transport position so that the sheet transferred onto the stacker is pressed onto the stacker by the sheet pushing member.

13. A sheet stacking apparatus according to claim 12, wherein said sheet pushing member pushes the sheet on the stacker when the sheet bending member is in a retracted position.

14. A sheet stacking apparatus comprising:

a support tray for stacking a sheet, aligning means disposed adjacent to the support tray for aligning an edge of the sheet on the support tray at a predetermined position, a stacker disposed adjacent to the support tray at a downstream side in a sheet transfer direction for storing the sheet fed from the support tray, sheet discharge means disposed adjacent to the support tray for transporting the sheet on the support tray to the stacker, a sheet bending member disposed between the support tray and the stacker at the downstream side of the sheet transfer direction relative to the aligning means and capable of moving between a protruding position protruding above the support tray for bending the sheet stacked on the support tray in a direction perpendicular to a direction that the sheet is transported and a retracted position away from the sheet, and drive means attached to the sheet bending member for moving the same between the retracted position when the sheet is aligned by the aligning means and the protruding position above the support tray when the sheet is transported from the support tray to the stacker;

wherein said sheet discharge means includes a sheet pushing member disposed adjacent to the support tray and moving in a direction that the sheet is discharged, and drive means for driving the sheet pushing member in the direction that the sheet is transported so that the sheet pushing means abuts against a trailing edge of the sheet to move the sheet; and wherein said sheet pushing member has a posture at a transport position so that the sheet transferred onto the stacker is pressed onto the stacker by the sheet pushing member.

15. A sheet stacking apparatus according to claim 14, wherein said sheet pushing member pushes the sheet on the stacker when the sheet bending member is in the retracted position.

* * * * *